US012773074B2

(12) United States Patent
Kim

(10) Patent No.: US 12,773,074 B2
(45) Date of Patent: Oct. 27, 2026

(54) ABSORBENT PRODUCT DISPENSER

(71) Applicant: Kimberly-Clark Worldwide, Inc., Neenah, WI (US)

(72) Inventor: SungWoo Kim, Osan-si (KR)

(73) Assignee: Kimberly-Clark Worldwide, Inc., Neenah, WI (US)

( * ) Notice: Subject to any disclaimer, the term of this patent is extended or adjusted under 35 U.S.C. 154(b) by 281 days.

(21) Appl. No.: 18/577,989

(22) PCT Filed: Jul. 9, 2021

(86) PCT No.: PCT/US2021/041006
§ 371 (c)(1),
(2) Date: Jan. 9, 2024

(87) PCT Pub. No.: WO2023/282907
PCT Pub. Date: Jan. 12, 2023

(65) Prior Publication Data
US 2024/0315499 A1 Sep. 26, 2024

(51) Int. Cl.
*A47K 10/38* (2006.01)

(52) U.S. Cl.
CPC ..... *A47K 10/38* (2013.01)

(58) Field of Classification Search
USPC ..... 242/598.6
See application file for complete search history.

(56) References Cited

U.S. PATENT DOCUMENTS

D4,174 S 6/1870 Bayer
2,122,048 A * 6/1938 Shapiro ..... B65D 83/0805 221/45
3,154,232 A 10/1964 Gage
4,071,200 A 1/1978 Stone
D248,198 S 6/1978 Gordon
(Continued)

FOREIGN PATENT DOCUMENTS

EP 1352602 A2 10/2003
GB 2270901 A 3/1994
(Continued)

OTHER PUBLICATIONS

Pinterest, "How to Make a DIY Leather and Wood Paper Towel Holder How to Make a DIY Leather and Wood Paper _ Towel holder diy, Diy towels, Diy holder", Mar. 9, 2021, https://in.pinterest.com/pin/771452611161352251/.
(Continued)

*Primary Examiner* — William A. Rivera
(74) *Attorney, Agent, or Firm* — KIMBERLY-CLARK WORLDWIDE, INC.

(57) ABSTRACT

A dispenser kit comprising a dispenser support cord configured to attach to a first roll holder configured to hold a first roll having a first sheet count; a housing comprising a top side piece, a front side piece and a back side piece, wherein the top side piece, front side piece and back side piece are disassembled in the dispenser kit and the flexible dispenser support cord is configured to attach to the top side piece; and wherein the top side piece, front side piece and back side piece are configured to be assembled to form the housing and wherein the housing is configured to accept a second roll having a second sheet count greater than the first sheet count.

18 Claims, 5 Drawing Sheets

(56) References Cited

U.S. PATENT DOCUMENTS

| | | | | |
|---|---|---|---|---|
| 4,106,617 | A * | 8/1978 | Boone | A47K 10/3818 206/812 |
| D269,468 | S | 6/1983 | Babcock et al. | |
| 4,483,491 | A | 11/1984 | Rainey | |
| D283,714 | S | 5/1986 | Petroulias | |
| D353,996 | S | 1/1995 | Boysen | |
| 5,378,301 | A | 1/1995 | Boreali et al. | |
| 5,479,877 | A | 1/1996 | Demboske | |
| D369,523 | S | 5/1996 | Olson | |
| 6,024,051 | A | 2/2000 | Simantob et al. | |
| D427,385 | S | 6/2000 | Wawzonek | |
| D468,944 | S | 1/2003 | Ong | |
| D521,778 | S | 5/2006 | Edwards | |
| D550,998 | S | 9/2007 | Edwards | |
| D555,732 | S | 11/2007 | Jour | |
| D626,699 | S | 11/2010 | Tang | |
| 8,783,600 | B1 | 7/2014 | Myron | |
| D774,323 | S | 12/2016 | Norton | |
| 11,771,271 | B1 * | 10/2023 | Danis | A47K 10/3687 242/594 |
| 12,414,657 | B2 * | 9/2025 | Zimmerman | A47K 10/32 |
| 2002/0092789 | A1 * | 7/2002 | Sauer | B65D 5/4208 206/806 |
| 2005/0178781 | A1 * | 8/2005 | Welchel | A47K 10/421 221/45 |
| 2005/0199690 | A1 * | 9/2005 | Peterson | B65D 5/0254 229/122.1 |
| 2006/0214048 | A1 * | 9/2006 | Sucher | B65H 16/06 242/598.5 |
| 2008/0042004 | A1 | 2/2008 | Byrd | |
| 2008/0067185 | A1 | 3/2008 | Schlaupitz et al. | |
| 2011/0024586 | A1 | 2/2011 | Brinkdopke et al. | |
| 2014/0027595 | A1 * | 1/2014 | Hunsaker | A47K 10/185 248/318 |
| 2015/0083743 | A1 * | 3/2015 | D'Angelo | A47K 10/38 221/45 |
| 2020/0324963 | A1 | 10/2020 | Goodrich | |
| 2022/0380114 | A1 * | 12/2022 | Shihor | A47K 10/42 |

FOREIGN PATENT DOCUMENTS

| | | | |
|---|---|---|---|
| JP | 2019195530 | A | 11/2019 |
| KR | 200182902 | Y1 | 6/2000 |
| WO | 2018058180 | A1 | 4/2018 |

OTHER PUBLICATIONS

Woodentwist, "Wooden Beautiful Design 2 Compartments Tissue Box & Napkin Holder", Mar. 9, 2021, https://woodentwist.com/products/wooden-beautiful-design-2-compartments-tissue-box-napkin-holder?variant=33272243847303&currency=INR&utm_medium=product_sync&utm_source=google&utm_content=sag_organic&utm_campaign=sag_organic&utm_campaign=gs-2020-02-01&utm_source=google&utm_medium=smart_campaign&gclid=EAIaIQobChMlsYLbILKi7wIVwUcrCh38ngjoEAQYBSABEgLyYfD_BwE.

Slivy Creative Horse Tissue Box Cover, available in Amazon.com, earliest available date Feb. 26, 2017 (Online), Retrieved on Aug. 7, 2023 from URL: https://www.amazon.com/Slivy-Creative-Household-Dispenser-Natural/dp/B07ZFTF6B3?th=1 (Year: 2017).

* cited by examiner

ABSORBENT PRODUCT DISPENSER

TECHNICAL FIELD

This disclosure generally relates to dispenser for dispensing absorbent (paper) products.

BACKGROUND OF THE DISCLOSURE

Systems dispensing consumable products are ubiquitous in many environments today. For example, rolled bath tissue dispensers are commonplace in private and semi-private washrooms. In many such washrooms the installed bath tissue dispenser may be designed to hold a standard capacity bath tissue roll. Although there is demand to have higher capacity (e.g., sheet count) rolls that, for example last longer and require less frequent replacement, many bath tissue dispensers are not able to hold such high capacity rolls. Thus, to use a higher capacity roll in the washroom, the old dispenser must be removed and replaced with a dispenser configured to hold a high capacity roll. Unfortunately removal of the old bath tissue dispenser often causes damage to the wall or structure to which the dispenser was mounted necessitating repairs, which can be costly and time consuming.

SUMMARY OF THE DISCLOSURE

In general, the subject matter of this specification relates to a paper product dispenser. One aspect of the subject matter described in this specification can be implemented in an apparatus that includes a dispenser kit comprising a dispenser support cord configured to attach to a first roll holder configured to hold a first roll having a first sheet count; a housing comprising a top side piece, a front side piece and a back side piece, wherein the top side piece, front side piece and back side piece are disassembled in the dispenser kit and the flexible dispenser support cord is configured to attach to the top side piece; and wherein the top side piece, front side piece and back side piece are configured to be assembled to form the housing and wherein the housing is configured to accept a second roll having a second sheet count greater than the first sheet count. Other embodiments of this aspect include corresponding methods and systems.

Another aspect of the subject matter described in this specification can be implemented in methods that include assembling, at an away-from-manufacturing location, a top side piece, a front side piece and a back side piece to form a housing; attaching a first end of a flexible dispenser support cord to the top side piece; attaching a second end of the flexible dispenser support cord to a first roll holder configured to hold a first roll having a first sheet count; and inserting a second roll, having a second sheet count greater than the first sheet count, into the housing. Other embodiments of this aspect include corresponding systems and apparatus.

Particular embodiments of the subject matter described in this specification can be implemented so as to realize one or more of the following advantages. For example, the dispenser made from the dispenser kit allows a higher capacity roll (e.g., a roll having a higher sheet count or longer unwound length) to be used without removing or replacing the standard (e.g., lower) capacity dispenser, which avoids any repairs that must be made to the wall supporting the standard capacity dispenser during removal of such dispenser (e.g., screw holes or tile or drywall damage). Using the higher capacity/dispenser roll also reduces the frequency with which the dispenser must be refilled which avoids the hassle and expense of unnecessary maintenance and a better user experience (by reducing the likelihood a given user will run out of paper product).

Further, the higher capacity dispenser can be attached/mounted to the existing, standard capacity dispenser, which avoids any additional mounting steps including avoiding having to attach the higher capacity dispenser to a support structure other than the standard dispenser (e.g., by screwing the higher capacity dispenser to a wall and damaging the wall/other support structure).

Given the dispenser is shipped in a disassembled state and, optionally, consisting of mostly flat pieces (e.g., side walls), the packaging footprint of the as shipped dispenser can be small to avoid shipping costs for larger packages. In some implementations the dispenser is made from a cardboard-type material that is lower cost than metal or injection molded plastic-based dispensers.

Additionally, as the dispenser is shipped as a kit to be assembled by the recipient at a site away from the manufacturing location (e.g., at a home by a home owner or child or at a school by a teacher or student), the kit serves as an art and/or entertainment project for the recipient, in addition to being a functional high capacity paper product dispenser.

The details of one or more implementations of the subject matter described in this specification are set forth in the accompanying drawings and the description below. Other features, aspects, and advantages of the subject matter will become apparent from the description, the drawings, and the claims.

Figure 1A:
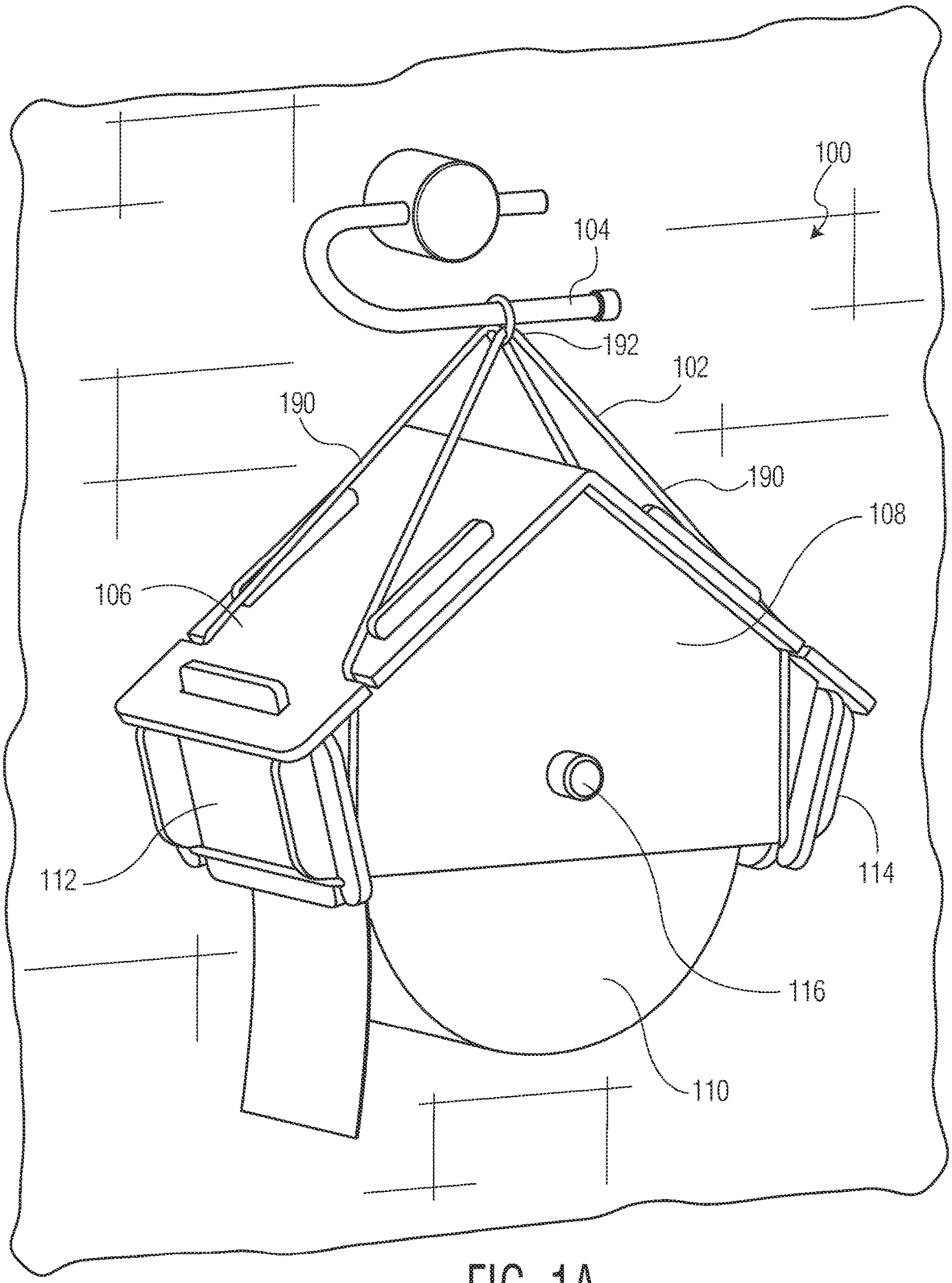
FIG. 1A is a representation of an example product dispenser.

Repeat use of reference characters in the present specification and drawings is intended to represent the same or analogous features or elements of the disclosure.

DETAILED DESCRIPTION OF THE DISCLOSURE

The present disclosure generally relates to a kit for a rolled product dispenser that accepts a high capacity roll (e.g., bath tissue, paper towel of wiper roll) and that can attach to an existing (e.g., already installed) rolled product dispenser, for example, only able to hold a lower capacity roll.

More specifically, in one implementation, the dispenser kit is intended to be assembled into an operational dispenser away from the manufacturing site of the dispenser kit, for example, at a home or school. The kit includes multiple pieces, for example, a top side piece, a front side piece and a back side piece, that are assembled at the recipient's location to form the main body of the dispenser housing.

The kit also includes a dispenser support cord (e.g., rope) or structure (e.g., a rigid bar or arm) to attach the housing to the roll holder (having a standard sheet count/capacity)

already installed at the recipient's location, for example, home or school. The housing of this dispenser kit is sized and configured to accept a roll having a higher capacity than the already installed, standard capacity roll holder (e.g., first roll holder). Capacity in this sense describes the number of sheets and/or aggregate length of sheets held by the dispenser. So a higher capacity dispenser holds a sheet product roll having more sheets and/or greater collective length of sheets on the roll than a lower capacity dispenser. By providing a dispenser with a higher capacity, the roll will not need to be replaced as often and therefore require less maintenance.

The dispenser kit is described in greater detail below with respect to FIG. 1A, which is a representation of an example product dispenser; FIG. 1B, which is a representation of an example kit of materials to assemble the dispenser of FIG. 1A; and FIG. 1C, which is a representation of a backside of the example dispenser of FIG. 1.

The example product dispenser 100 from this kit can be, for example, a bath tissue dispenser 100, a hand towel dispenser 100, a wipe or wiper dispenser 100 or the like for rolled paper products. Paper products describes sheet materials made from cellulose fibers (e.g., wood pulp), synthetic fibers (e.g., polypropylene) or some combination thereof, and include, for example, paper towels, bath tissue, and wipers. A rolled product is an interconnected/perforated (or continuous/unperforated) sheet product that is wound around a core (or center axis), and includes rolled product that is unwound from its core outward towards its periphery or, alternatively, unwound from its periphery inward towards its core.

In some implementations, a dispenser kit includes the components necessary to assemble the dispenser 100 into a functional dispenser and is shipped to a location away from the manufacturing site of the dispenser kit, e.g., a home or school, for assembly by the recipient of the shipped kit or by an end user of the dispenser (in either case a person whose primary job is not assembling dispensers). In addition to assembly instructions, the dispenser kit can include, for example, a top side piece 106, front side piece 108, back side piece 109, left side piece 112, right side piece 114, spindle 116, support cord 102 or some combination thereof. The top side piece 106, front side piece 108, back side piece 109, left side piece 112, right side piece 114 or some combination thereof forms the dispenser housing, which defines a space or cavity within the dispenser 100 in which the second roll 110 can be held and positioned for dispensing. In other implementations, the housing can be formed from a unitary structure, come preassembled or otherwise use more or less pieces than the top side piece 106, front side piece 108, back side piece 109, left side piece 112, and right side piece 114.

As shown in FIG. 1B the components of the housing can be, for example, flat or substantially planar pieces and/or foldable (e.g., in a shipping configuration before assembly). Substantially planar means having a radius of curvature along the major surface (e.g., the surface having the largest area) of the piece of less than thirty degrees, preferably less than fifteen degrees, more preferably less than five degrees, and even more preferably less than two degrees measured from the apex of the curvature to a distal end of the major surface For example, top side piece 106 forming some or all of the top side of the dispenser 100 can be shipped in a flat configuration (e.g., as shown in FIG. 1B) but foldable along line 182 to provide the three dimensionality of the top side piece 106 shown in FIG. 1A in an assembled form. The housing components, for example, can be made from cardboard (e.g., treated to provide some degree or humidity and/or water splash resistance), plastic, metal, or some combination thereof. For clarity, in FIG. 1B, only one of the left and right side pieces 112, 114 is shown and only one of the front and back side pieces 108, 109 is shown.

More generally, the various pieces/components of the dispenser kit can be assembled to form the dispenser 100 according to a set of instructions included in the dispenser kit or otherwise accessible to the recipient (e.g., available at an online site). For example, for each of the left and right side pieces 112, 114, the openings 178 can be slid into the respective openings 174 of the front and back side pieces 108, 109. For each of the front and back side pieces 108, 109 the projections 172 may be inserted into respective openings 170 of the top side piece 106, with the top side piece partially folded along line 182 to follow the top contour/angle of the front and back side pieces 108, 109.

Likewise, for each of the left and right side pieces 112, 114, the projections 176 can be inserted into respective openings 180 of the top side piece 106. Any engagement between various pieces can be, for example, a friction-type fit, although other attachment mechanisms are also possible such as through adhesives, snap fits and the like. In some implementations, for example, this friction, interference, or adhesive type assembly enables the dispenser 100 to be assembled without tools (e.g., without a hammer, screw driver, drill or the like).

Figure 2:
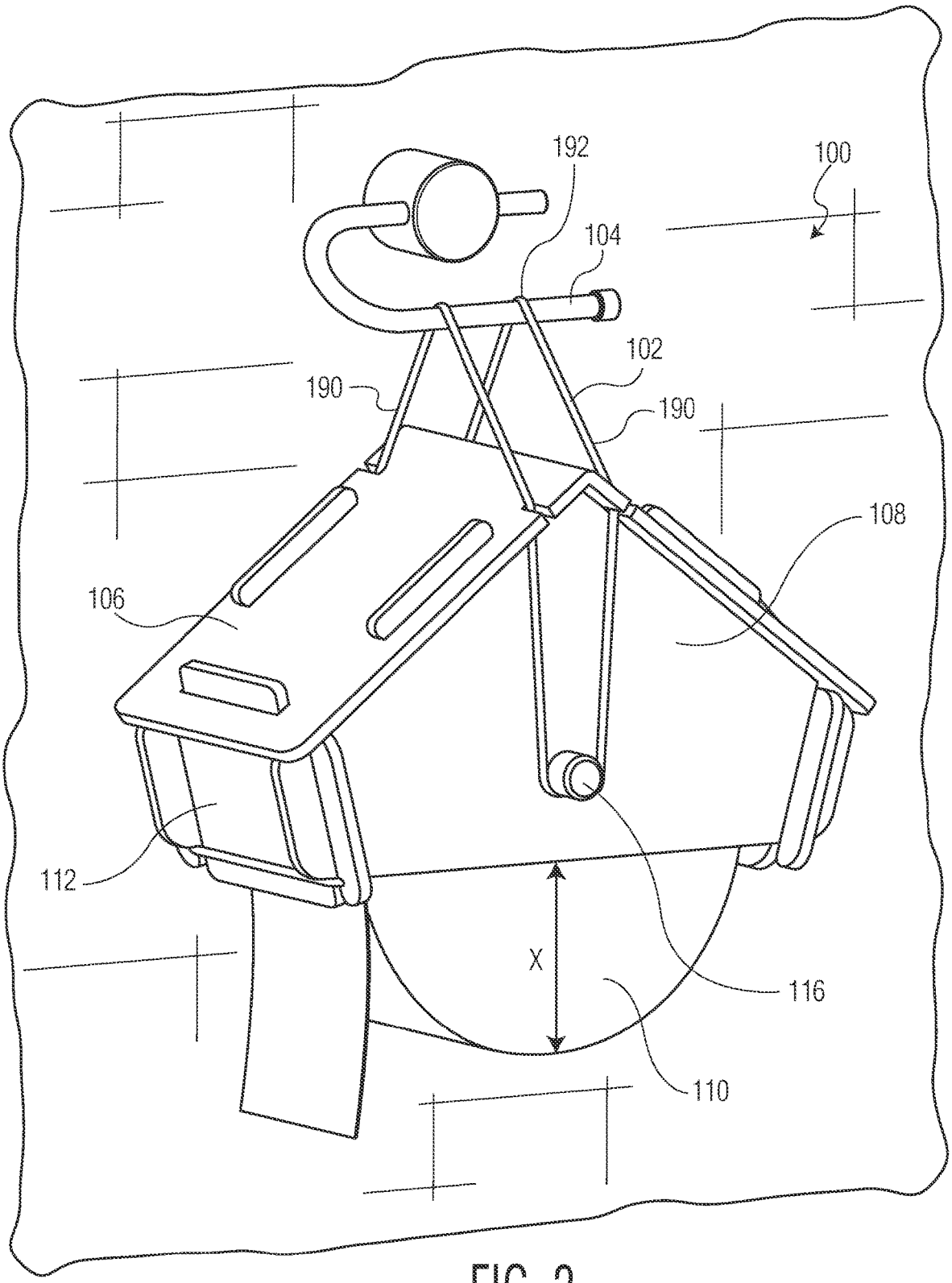
FIG. 2 is a representation of another example product dispenser.

The spindle 116 can be inserted through and rest in openings 182 of the front and back side pieces 108, 109. The dispenser support structure 102 connects the dispenser 100 to the first roll holder 104, for example, to allow the dispenser 100 to hang or be positioned below the first roll holder 104 and, optionally, not require the dispenser 100 to otherwise be attached to another support member, e.g., a wall or stand. In some implementations, the dispenser support structure 102 is a flexible cord or rope; however, in other implementations, the dispenser support structure 102 is a rigid bar or arm that connects the dispenser 100 to, and supports the dispenser 100 from, the first roll holder 104. In some implementations, the support structure 102 can attach to the spindle 116 as shown in FIG. 2.

Figure 1B:
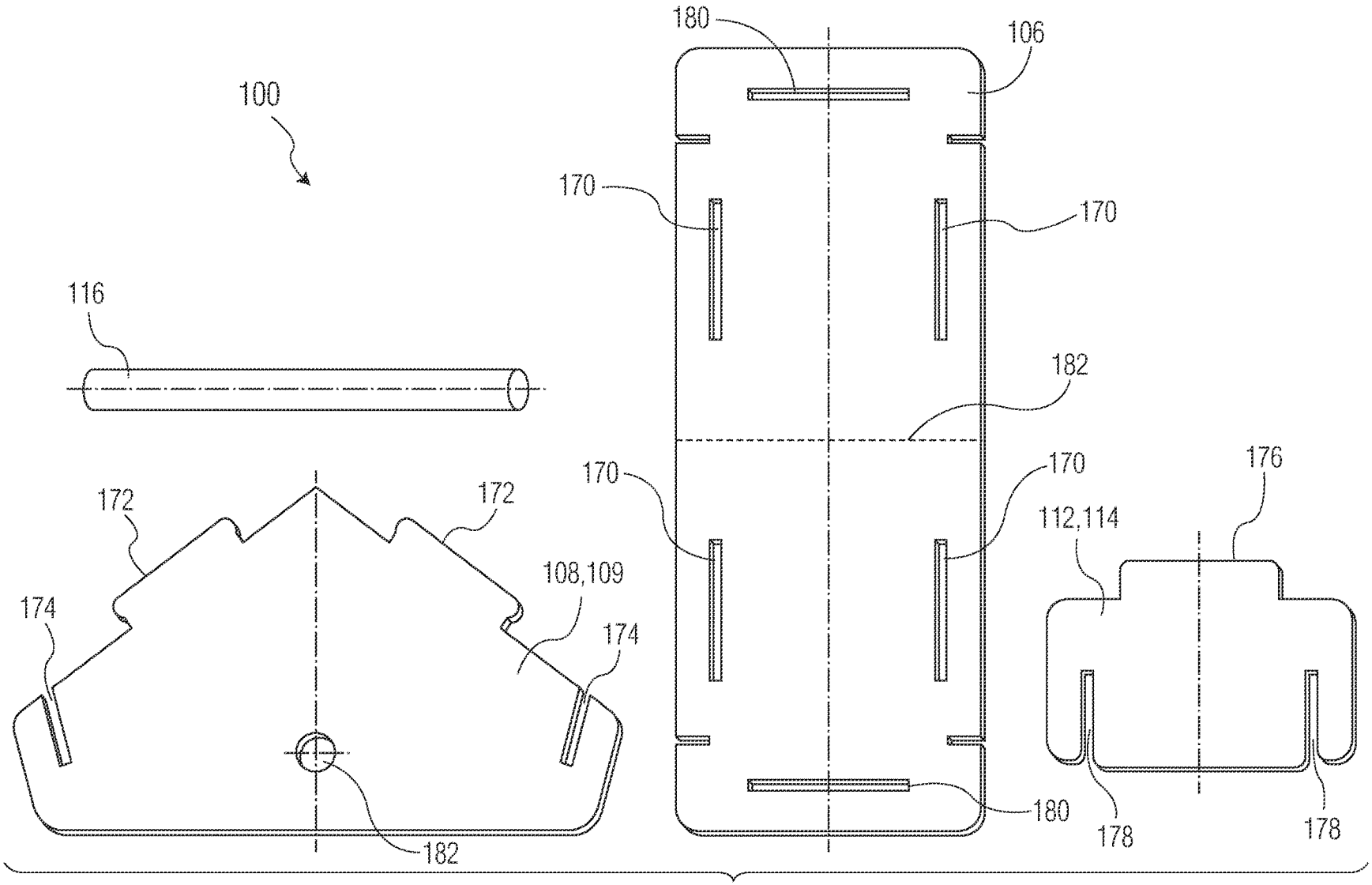
FIG. 1B is a representation of an example kit of materials to assemble the dispenser of FIG. 1A.
Figure 1C:
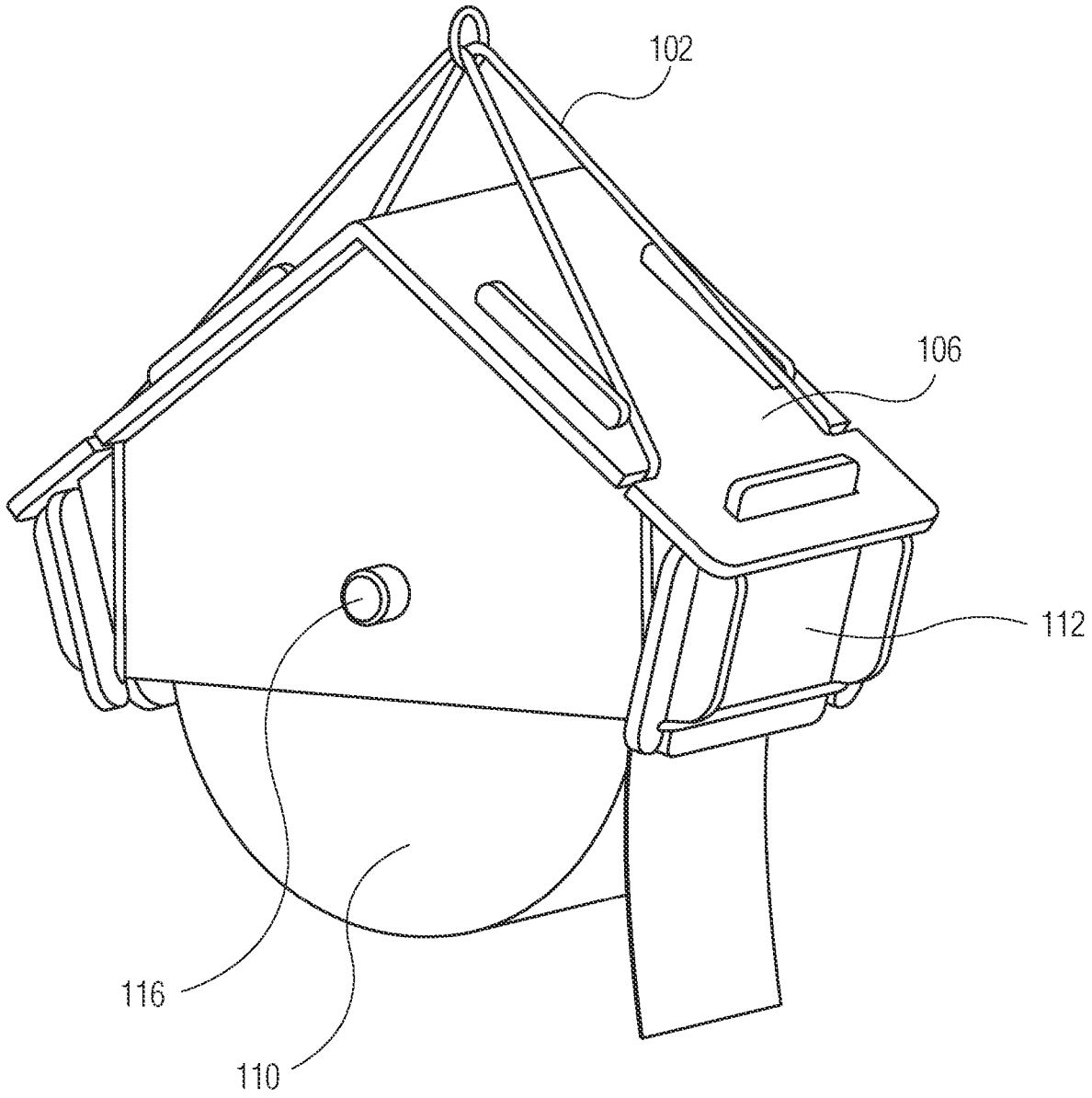
FIG. 1C is a representation of a backside of the example dispenser of FIG. 1.

In some implementations, the first roll holder 104 holds the first roll in a first orientation (e.g., with the core of the first roll being parallel to the wall on which first roll holder 104 is mounted) and the dispenser 100 holds the second roll 110 in a second orientation transverse to the first orientation (e.g., perpendicular to the wall on which first roll holder 104 is mounted), as shown in FIG. 1A.

In operation as a functional dispenser 100, a paper product 110 would be inserted into the housing and then the spindle 116 would be inserted into and through an opening 182 in one of the front and back side pieces 108, 109, through the core of the product 110 and then through the opening 182 in the other of the front and back side pieces 108, 109. In this way the product 110 is supported by the spindle 116 in the housing such that the product 110 can be unwound by a user pulling a tail of the sheet of the product 110 (or otherwise) causing the product to unwind by rotating on the spindle 116 and/or by the spindle 116 rotating within the openings 182.

As described above, in some implementations, the dispenser 100 is attached to (e.g., hung from) a first roll holder 104 or other dispenser 104 already installed in, for example, the washroom or bathroom. For example, the first roll holder 104 can be designed to hold a first roll (e.g., bath tissue roll) having a first capacity (e.g., sheet count or aggregate length of sheets on the roll). This could be, for example, a conventional bath tissue roll holder 104 as shown in FIG. 1A. The dispenser 100 allows for a second roll 110 to be held in the dispenser 100 (attached to the first roll holder 104) having a higher capacity than the first roll. For example, the first roll has 200 to 400 sheets and the second roll 110 has 900 to 1100 sheets (e.g., where the individual sheets on each roll are the same size).

The housing of the dispenser 100 can provide water or splash protection to the second roll 110 by covering some portion of the second roll 110. For example, the housing can cover 50%, 75% or 90% of the diameter of the second roll 110 to prevent or reduce the likelihood that the covered portion of the second roll 110 is directly exposed to the surrounding environment. The uncovered diameter portion of the second roll 110 is shown by X in FIG. 2.

Figure 3:
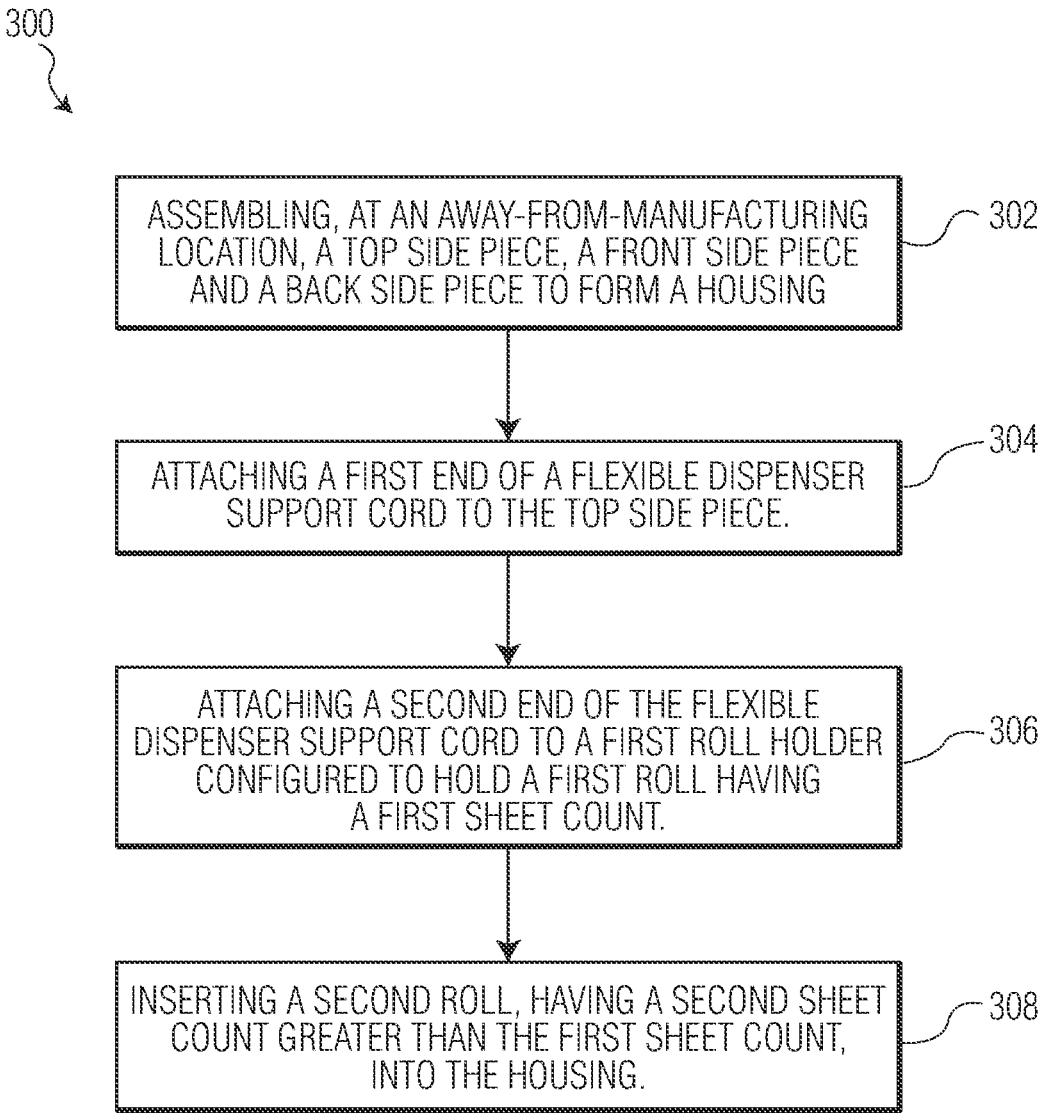
FIG. 3 is a flow chart of an example process for assembling a paper product dispenser.

FIG. 3 is a flow chart of an example process 300 for assembling a paper product dispenser, for example, assembling dispenser 100.

Assembling, at an away-from-manufacturing location, a top side piece, a front side piece and a back side piece to form a housing (302). For example, assembling, at an away-from-manufacturing location like a home or school, the top side piece 106, front side piece 108, and back side piece 109; the top side piece 106 left side piece 112, and right side piece 114; or the top side piece 106, front side piece 108, back side piece 109, left side piece 112, and right side piece 114.

Attaching a first end of a dispenser support cord to the top side piece (304). For example, attaching a first end 190 of a dispenser support cord 104 to the top side piece 106. The first end 190 could be attached to a feature of the top side piece 106, for example, an anchor or notch integral to the top side piece 106. In some implementations the first end 190 could be attached to either (e.g., both) ends of the spindle 116 and/or other pieces of the housing (e.g., top side piece 106, front side piece 108, back side piece 109, left side piece 112, and/or right side piece 114).

Attaching a second end of the dispenser support cord to a first roll holder configured to hold a first roll having a first sheet count (306). For example, attaching the second end 192 of the dispenser support cord 102 to the first roll holder 104 configured to hold a first roll having a first sheet count. The second end 192 could be attached to the first roll holder 104 by slipping over/hanging from the portion of the first roll holder 104 intended to receive the core of the first roll (e.g., a horizontal arm of the first roll holder 104).

Inserting a second roll, having a second sheet count greater than the first sheet count, into the housing (308). For example, inserting the second roll 110, having a second sheet count greater than the first sheet count, into the housing of the dispenser 100. As described above the dispenser 100 may include a spindle 116, and the second roll 110 can be inserted in the housing of the dispenser 100 by removing the spindle 116, inserting the second roll 110 into the housing, inserting the spindle 116 through openings in two parallel sides (e.g., 112, 114 or 108, 110) of the dispenser 100.

EMBODIMENTS

Embodiment 1. A dispenser kit comprising a dispenser support structure configured to attach to a first roll holder configured to hold a first roll having a first sheet count; a housing comprising a top side piece, a front side piece and a back side piece, wherein the top side piece, front side piece and back side piece are disassembled in the dispenser kit and the dispenser support structure is configured to attach to at least one of the top side piece, front side piece and back side piece; and wherein the top side piece, front side piece and back side piece are configured to be assembled to form the housing and wherein the housing is configured to accept a second roll having a second sheet count greater than the first sheet count.

Embodiment 2. The dispenser kit of embodiment 1, comprising a spindle having a first end configured to engage the front side piece when the housing is assembled and a second end configured to engage the back side piece when the housing is assembled, and wherein the spindle is configured to engage a core of the second roll when the roll is in the housing to allow the second roll to rotate about or with the spindle.

Embodiment 3. The dispenser kit of any preceding embodiment, wherein the first roll holder is configured to hold the first roll in a first orientation and the spindle is configured to hold the second roll in a second orientation transverse to the first orientation.

Embodiment 4. The dispenser kit of any preceding embodiment, wherein at least 25% of a diameter of the second roll is exposed when the second roll in the second orientation.

Embodiment 5. The dispenser kit of any preceding embodiment, wherein the housing comprises cardboard.

Embodiment 6. The dispenser kit of any preceding embodiment, wherein the housing comprises a left side piece positioned between first ends of the front and back side pieces and a right side piece positioned between second ends of the front and back side pieces.

Embodiment 7. The dispenser kit of embodiment 6, wherein at least three of the front side piece, the back side piece, the left side piece and the right side piece are substantially planar.

Embodiment 8. The dispenser kit of embodiment 7, wherein each of the front side piece, the back side piece, the left side piece and the right side piece are substantially planar.

Embodiment 9. A method comprising assembling, at an away-from-manufacturing location, a top side piece, a front side piece and a back side piece to form a housing; attaching a first end of a flexible dispenser support cord to the top side piece; attaching a second end of the flexible dispenser support cord to a first roll holder configured to hold a first roll having a first sheet count; and inserting a second roll, having a second sheet count greater than the first sheet count, into the housing.

Embodiment 10. The method of embodiment 9, wherein assembling, at an away-from-manufacturing location, a top side piece, a front side piece and a back side piece to form a housing comprises assembling a left side piece positioned between first ends of the front and back side pieces and a right side piece positioned between second ends of the front and back side pieces.

Embodiment 11. A method of embodiment 9, wherein the first roll holder is configured to hold the first roll in a first orientation and the housing is configured to hold the second roll in a second orientation transverse to the first orientation.

Embodiment 12. The method of embodiment 11, wherein at least 25% of a diameter of the second roll is exposed when the second roll in the second orientation.

Embodiment 13. The method of any of embodiments 9-12, wherein the housing comprises cardboard.

Embodiment 14. The method of any of embodiments 9-13, wherein the housing comprises a left side piece positioned between first ends of the front and back side pieces and a right side piece positioned between second ends of the front and back side pieces.

Embodiment 15. The method of embodiment 14, wherein at least three of the front side piece, the back side piece, the left side piece and the right side piece are substantially planar.

Embodiment 16. The method of embodiment 15, wherein each of the front side piece, the back side piece, the left side piece and the right side piece are substantially planar.

Embodiment 17. The method of any of embodiments 9-16, wherein the assembling comprises assembling without tools.

Embodiment 18. The method of any of embodiments 9-17, wherein the flexible dispenser support cord is a rope.

Embodiment 19. The method of any of embodiments 9-18, wherein the away-from-manufacturing location is a residence or school.

Embodiment 20. A dispenser kit comprising a dispenser support structure configured to attach to a first roll holder configured to hold a first roll having a first sheet capacity; and a housing comprising multiple pieces to be assembled into the housing by an end user of the dispenser and at a location away from the manufacturing site of the dispenser kit, wherein the housing is configured to attach to the dispenser support structure and hold a second roll having a second sheet capacity greater than the first sheet capacity.

When introducing elements of the present disclosure or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements. While this specification contains many specific implementation details, these should not be construed as limitations on the scope of any invention or of what may be claimed, but rather as descriptions of features that may be specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

What is claimed is:

1. A dispenser kit comprising:

a dispenser support structure configured to attach to a first roll holder on a wall, and configured to hold a first roll having a first sheet count;

a housing comprising a top side piece, a front side piece and a back side piece, wherein the top side piece, front side piece and back side piece are disassembled in the dispenser kit and the dispenser support structure is configured to attach to at least one of the top side piece, front side piece and back side piece; and wherein the top side piece, front side piece and back side piece are configured to be assembled to form the housing and wherein the housing is configured to accept a second roll having a second sheet count greater than the first sheet count, and wherein the first roll holder is configured to hold the first roll in a first orientation and the spindle is configured to hold the second roll in a second orientation transverse to the first orientation such that the spindle is perpendicular to the wall on which first roll holder is mounted.

2. The dispenser kit of claim 1 comprising a spindle having a first end configured to engage the front side piece when the housing is assembled and a second end configured to engage the back side piece when the housing is assembled, and wherein the spindle is configured to engage a core of the second roll when the roll is in the housing to allow the second roll to rotate about or with the spindle.

3. The dispenser kit of claim 1, wherein at least 25% of a diameter of the second roll is exposed when the second roll in the second orientation.

4. The dispenser kit of claim 1, wherein the housing comprises cardboard.

5. The dispenser kit of claim 1, wherein the housing comprises a left side piece positioned between first ends of the front and back side pieces and a right side piece positioned between second ends of the front and back side pieces.

6. The dispenser kit of claim 5, wherein at least three of the front side piece, the back side piece, the left side piece and the right side piece are substantially planar.

7. The dispenser kit of claim 6, wherein each of the front side piece, the back side piece, the left side piece and the right side piece are substantially planar.

8. A method comprising:

assembling a dispenser kit at a location different from the manufacturing site of the dispenser kit, comprising assembling a top side piece, a front side piece and a back side piece to form a housing;

attaching a first end of a flexible dispenser support cord to the top side piece;

attaching a second end of the flexible dispenser support cord to a first roll holder mounted on a wall and configured to hold a first roll having a first sheet count; and inserting a second roll, having a second sheet count greater than the first sheet count, into the housing, wherein a core of the second roll is perpendicular to the wall on which first roll holder is mounted.

9. The method of claim 8, wherein assembling a dispenser kit at a location different from the manufacturing site of the dispenser kit, a top side piece, a front side piece and a back side piece to form a housing comprises assembling a left side piece positioned between first ends of the front and back side pieces and a right side piece positioned between second ends of the front and back side pieces.

10. The method of claim 8, wherein at least 25% of a diameter of the second roll is exposed when the second roll in the second orientation.

11. The method of claim 8, wherein the housing comprises cardboard.

12. The method of claim 8, wherein the housing comprises a left side piece positioned between first ends of the front and back side pieces and a right side piece positioned between second ends of the front and back side pieces.

13. The method of claim 12, wherein at least three of the front side piece, the back side piece, the left side piece and the right side piece are substantially planar.

14. The method of claim 13, wherein each of the front side piece, the back side piece, the left side piece and the right side piece are substantially planar.

15. The method of claim 8, wherein the assembling comprises assembling without tools.

16. The method of claim 8, wherein the flexible dispenser support cord is a rope.

17. The method of claim 8, wherein a location different from the manufacturing site of the dispenser kit is a residence or school.

18. A dispenser kit comprising:

a dispenser support structure configured to attach to a first roll holder mounted to a wall and configured to hold a first roll having a first sheet capacity; and a housing comprising multiple pieces to be assembled into the housing by an end user of the dispenser, wherein the housing is configured to attach to the dispenser support structure and hold a second roll having a second sheet capacity greater than the first sheet capacity, wherein a core of the second roil is perpendicular to the wall on which first roll holder is mounted.

* * * * *